United States Patent [19]

Ward et al.

[11] Patent Number: 5,063,617

[45] Date of Patent: Nov. 12, 1991

[54] HYDRAULIC TOILET SEAT

[76] Inventors: Walter J. Ward, 94 Risley St., East Hartford; Ellwyn St. Louis, 244 Old Springfield Rd., Stafford Springs, Conn. 06076; Frederick A. Ward, Rte. 1, Box 40B, Cairo, Mo. 65239

[21] Appl. No.: 583,197

[22] Filed: Sep. 17, 1990

[51] Int. Cl.[5] ..... A47K 13/10

[52] U.S. Cl. ..... 4/251; 297/DIG. 10

[58] Field of Search ..... 4/237, 251, 254, 561, 4/563, 564, 565, 566; 297/DIG. 10

[56] References Cited

U.S. PATENT DOCUMENTS

| | | | |
|---|---|---|---|
| 2,849,728 | 9/1958 | Gyllenberg | 4/251 |
| 3,473,174 | 10/1969 | Cool | 4/251 |
| 3,479,087 | 11/1969 | Burke | 297/DIG. 10 |
| 3,490,082 | 1/1970 | Murcott | 4/239 |
| 3,925,833 | 12/1975 | Hunter | 4/251 |
| 4,168,552 | 9/1979 | Austin | 4/237 |
| 4,185,335 | 1/1980 | Alvis | 4/251 |
| 4,581,778 | 4/1986 | Pontoppidan | 4/251 |
| 4,587,678 | 5/1986 | Love et al. | 4/251 |
| 4,631,759 | 12/1986 | Strasser | 4/252 R |
| 4,777,671 | 10/1988 | Kearns | 4/251 |
| 4,833,736 | 5/1989 | Sadler et al. | 4/251 |
| 4,884,841 | 12/1989 | Holley | 4/254 X |
| 4,907,303 | 3/1990 | Baird | 4/480 |
| 4,993,085 | 2/1991 | Gibbons | 4/251 |

FOREIGN PATENT DOCUMENTS

| | | | |
|---|---|---|---|
| 2519861 | 7/1983 | France | 297/DIG. 10 |
| 658783 | 12/1986 | Switzerland | 4/251 |

OTHER PUBLICATIONS

Advertisement: "Valette Independence in the Washroom" by the New Product Store of Ontario, Canada.

*Primary Examiner*—Henry J. Recla
*Assistant Examiner*—Robert M. Fetsuga
*Attorney, Agent, or Firm*—Ira S. Dorman

[57] ABSTRACT

An hydraulic toilet seat assembly utilizes available household water pressure to lift, elevate and lower a toilet seat so as to facilitate mounting and dismounting by a person who is disabled or infirm. As the seat rises it assumes a forwardly pitched orientation to further facilitate use. A positive displacement fluid divider unit delivers to hydraulic motors appropriate volumes of water to drive motor pistons through different distances, so as to produce the desired seat inclination.

15 Claims, 5 Drawing Sheets

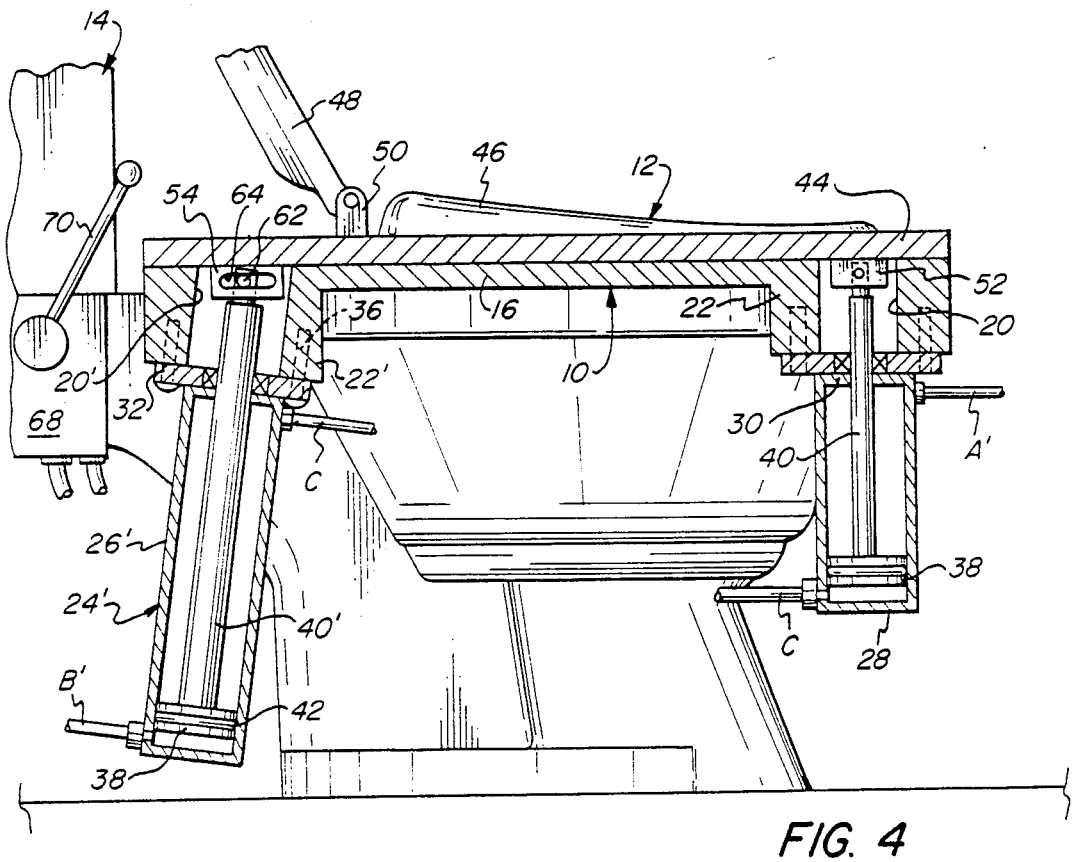
FIG. 4
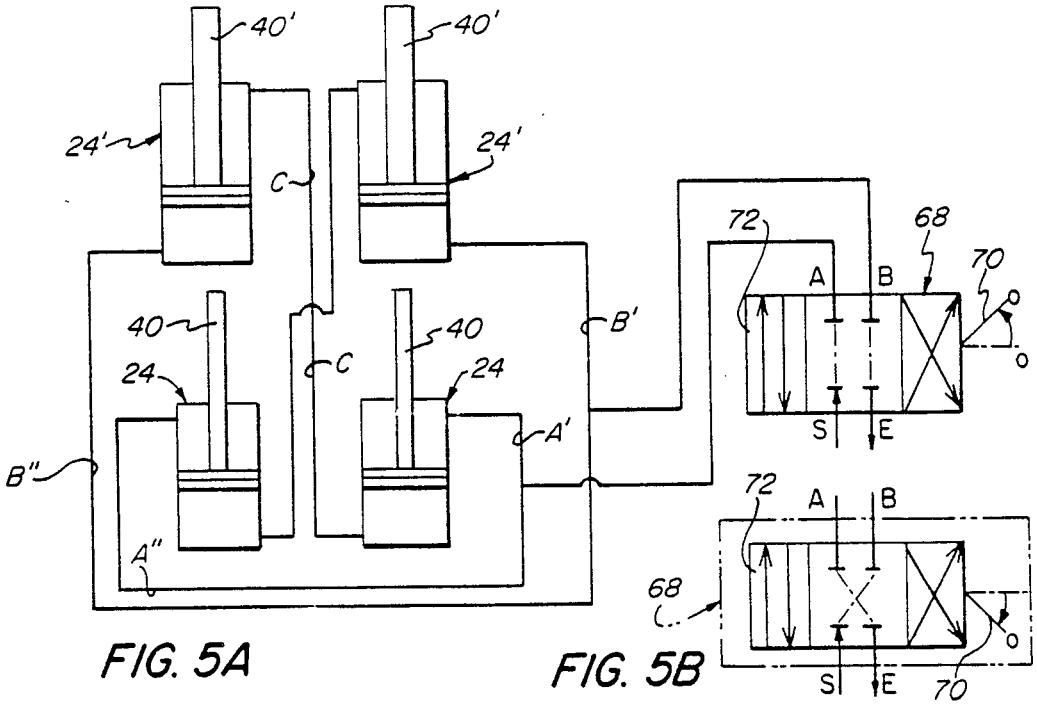
FIG. 5A
FIG. 5B

HYDRAULIC TOILET SEAT

BACKGROUND OF THE INVENTION

For many who are disabled or infirm, the mounting and dismounting of a toilet is difficult or impossible to achieve without assistance. This is attributable, in large measure, to a lack of the degree of lower body strength, flexibility or control that is necessary to enable adequate or confident movement between erect and crouched positions.

It is believed that power-assisted toilet seat mechanisms may previously have been proposed for use in lowering a person to, and elevating him from, a toilet. Applicants are not aware however that any such apparatus has been provided heretofore which would perform in an entirely satisfactory manner, as a practical matter, or which is adapted for ready installation in assembly with an existing toilet facility.

A feature that would be particularly desirable in an elevating mechanism of the kind described is one by which automatic forward tilting of the seating member, in elevated positions, would be effected. Another would be the ability to utilize existing household water supply sources for powering of the mechanism. Consequently, a hydraulic system that is capable of raising and lowering the seat, while changing its attitude from horizontal to inclined, would be most advantageous. That in turn implies means for apportioning a common water supply so as to effect differential movement of driven components.

It is therefore a broad object of the present invention to provide a novel toilet seat assembly that can be raised and lowered by hydraulic means, and powered by available household water pressure.

A more specific object is to provide such an assembly in which the seat member automatically assumes a forward tilt as it is brought to higher levels, and returns to horizontal as it is lowered.

Other objects of the invention are to provide unique hydraulic operating means suitable for use for driving such a seat assembly; and in particular to provide a liquid divider unit for apportioning water flow from a common source so as to drive hydraulic motors having capacities that differ from one another.

Additional objects are to provide such an assembly which is secure, stable and reliable, which is relatively uncomplicated and inexpensive to manufacture and facile to install, and which is comfortable, convenient and highly effective in use; and to provide such a divider unit which is also relatively uncomplicated and inexpensive to manufacture and facile to install, and is highly reliable and effective in use.

SUMMARY OF THE INVENTION

It has now been found that certain of the foregoing and related objects of the invention are attained by the provision of an hydraulic toilet seat assembly comprising a toilet seat member and hydraulic operating means, the latter including at least one front motor and one back motor. Means is provided for connecting the motors to an hydraulic supply, for simultaneous operation, and each motor has a piston which is movable between fully retracted and extended positions, the pistons of the front and back motors being operatively connected to the forward and rearward portions of the seat member, respectively. The travel length of the back motor piston is substantially greater than that of the front motor piston, so that the seat member is in a lowered and generally horizontal attitude when the pistons are in their fully retracted positions, and is elevated and in a forwardly tilted attitude when the pistons are extended.

Each motor will usually comprise a generally vertically disposed hydraulic cylinder in which the piston is slidably mounted. The pistons will consist of a head, having an upper side and a lower side, and an attached rod extending from the upper side and operatively connected to the seat member; the rod of the front motor piston will normally be substantially shorter than that of the back motor piston.

In preferred embodiments the assembly will include two front motors and two back motors, with the pistons of one of the front motors and one of the back motors being operatively connected to one lateral side of the seat member, and with the pistons of the other two motors being so connected on the opposite side of the seat member. The assembly will usually include a base that is adapted for mounting upon the bowl of a toilet, and that supports the hydraulic motors.

Each motor cylinder will generally have ports adjacent its upper and lower ends, communicating with internal spaces above and below the head of the piston, respectively. In such a case the assembly will additionally include an hydraulic line attached to each port, with the port adjacent the upper end of the back motor cylinder connected, by a common hydraulic line, to the port adjacent the lower end of the front motor cylinder. When the assembly includes two front and two back motors, the common hydraulic lines will desirably be arranged to establish crossover connections.

The cylinders of all motors will advantageously be of the same inside diameter, with the front motor cylinders being substantially shorter, and of substantially smaller cross section, than those in the back. Water flow into and from the motors will usually be controlled by an hydraulic valve that is operatively connected to the front and back motors, and that is adapted for connection to a pressurized water supply and to a water discharge sink.

In particularly preferred embodiments, the hydraulic operating means of the assembly will include a liquid divider unit for apportioning the water supplied into different volumetric amounts. Such a divider unit will desirably include a plurality of jointly operative pumping sections, one for receiving and delivering to the front motor a first volumetric amount of water, and another for receiving and delivering to the back motor a second volumetric amount, the "second" volumetric amount of water being larger than the "first" and sufficient to produce the extra travel length required for the back motor piston.

Each of the pumping sections may comprise, more specifically, a rotor that is rotatably disposed within a discrete body cavity, and that cooperates with it to dynamically create compartments of continuously increasing and decreasing volume. The body will provide an inlet to and an outlet from each cavity, disposed so as to permit the rotors, operatively interengaged for conjoint rotation, to draw water thereinto and discharge water therefrom.

In an especially desirable form of the divider unit the cavities will be cylindrical and coaxial, and the rotors will include cores that are also cylindrical, but of a smaller diameter, and disposed on a common axis of rotation parallel to and offset from the axis of the cavities. Each rotor will include a plurality of vanes that are slidably mounted, at equiangularly spaced positions about the core, for radial movement so as to maintain constant, sliding engagement with the walls of the body defining the cavities. When designed for use in a system for hydraulic operation of a toilet seat member, as described, the divider unit will usually include four pumping sections. Each of two of the sections will receive and deliver a first volumetric amount of water, with each of the other two receiving and delivering water in a second volumetric amount, the amounts being established so as to concurrently drive pairs of cylinders having capacities that differ from one another.

Other objects of the invention are attained by the provision of a liquid divider unit as hereinabove and hereinafter described.

BRIEF DESCRIPTION OF THE DRAWINGS

FIG. 4 is an elevational view similar to FIG. 2, showing the toilet seat member in its fully lowered position;

FIG. 5A is a schematic representation of the hydraulic system by which the seat member is raised and lowered, and FIG. 5B depicts the hydraulic valve of the system in an alternate position;

DETAILED DESCRIPTION OF THE ILLUSTRATED EMBODIMENTS

Figure 1:
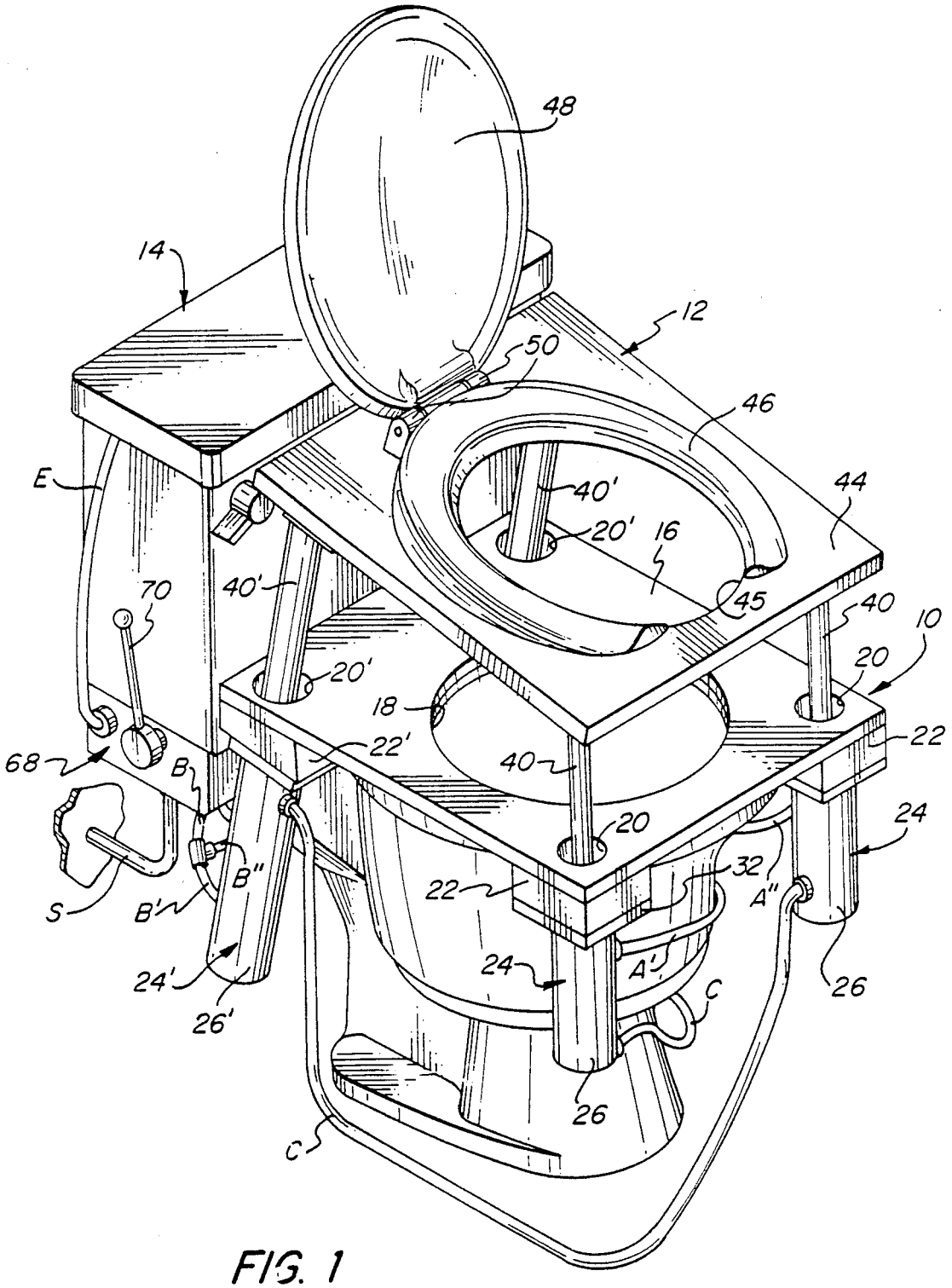
FIG. 1 is a perspective view of an hydraulic toilet seat assembly embodying the present invention, with the toilet seat member in its fully elevated position.

Turning in detail initially to FIGS. 1–4 of the appended drawings, therein illustrated is an assembly embodying the present invention and consisting of a base, generally designated by the numeral 10, and a seat member generally designated by the numeral 12. The base 10 is mounted upon and supported by the bowl portion of a conventional toilet, generally designated by the numeral 14, and consists of a rectangular platform 16 having a central opening 18 and four passages 20, 20' at its corners. An enlarged, block-like structure 22, 22', through which the corresponding passage 20, 20' extends, is disposed at each corner on the underside of the platform 16.

A hydraulic cylinder, generally designated by the numeral 24, 24', is attached to the base 10 at each corner, and consists of a cylindrical sidewall 26, 26' closed by a bottom wall 28 and a top wall 30. It will be noted that the sidewalls 26, 26' of the cylinders 24, 24', respectively, are of the same diameter but of different lengths. The top walls 30 are joined to mounting plates 32, which in turn abut the bottom surfaces 34, 34' of the enlargements 22, 22', and are secured thereagainst by fasteners 36.

Disposed within the cylinder 24, 24' of each motor is a piston having a head 38 with a circumscribing sealing ring 42, and having a rod 40, 40' extending from the upwardly oriented face of the head. The pistons are mounted for slidable, reciprocal movement within the cylinders of the motors, with the rods 40, 40' thereof extending upwardly through the respective passages 20, 20' in the platform 16. It might be noted at this point that the rods 40' are longer than the rods 40 (corresponding to the length differentials of the associated cylinders 24, 24'), and that they are of substantially greater diameter.

The seat member 12 consists of a rectangular platform 44 having a centrally located opening 45, substantially surrounded by generally annular seat structure 46. The member 12 includes a lid 48, pivotably mounted by fixtures 50 and disposed to cover the opening 45 and the seat structure 46 in its lowered position. A forward clevis 52 and a rearward clevis 54 are mounted (as by the screw 66 seen in FIG. 3) against the underside of the panel 44, each serving to receive between its lateral elements the reduced-diameter end portion 56, 60 of the piston rod 40, 40', respectively. Pins 58, 62 extend transversely through aligned openings in the lateral clevis elements and the reduced rod end portions, to pivotably attach the piston rods to the seat member 12. It will be noted that the openings 64 (only one of which is visible) through the rear clevis 54 are in the form of slots, which permit the limited amount of shifting of the pin 62 that is necessary to accommodate the inclination of the rearward rods 40' and length differentials that exist between them and the forward rods 40.

With particular reference now to FIGS. 5A and 5B, a control system suitable for use with the assembly of the invention is schematically illustrated, and includes a hydraulic valve 68 having an operating lever 70. Two lines A and B extend from the valve 68, each having two branches, A', A" and B', B", respectively. The branches A', A" are attached adjacent the tops of the front motor cylinders 24, communicating with the space therewithin above the piston heads 38, and the branches B', B" are attached adjacent the bottoms of the back motor cylinders 24', communicating below the heads of the associated pistons. Common lines C connect the upper ends of the back cylinders 24' with the lower ends of the front cylinders 24. A supply line S running, for example, from a household municipal water supply, is attached to the valve 68. An exit line E is also attached to the valve, and runs (as shown in FIG. 1) along the side of the tank of the toilet 14 and under its cover into the internal chamber.

Figure 2:
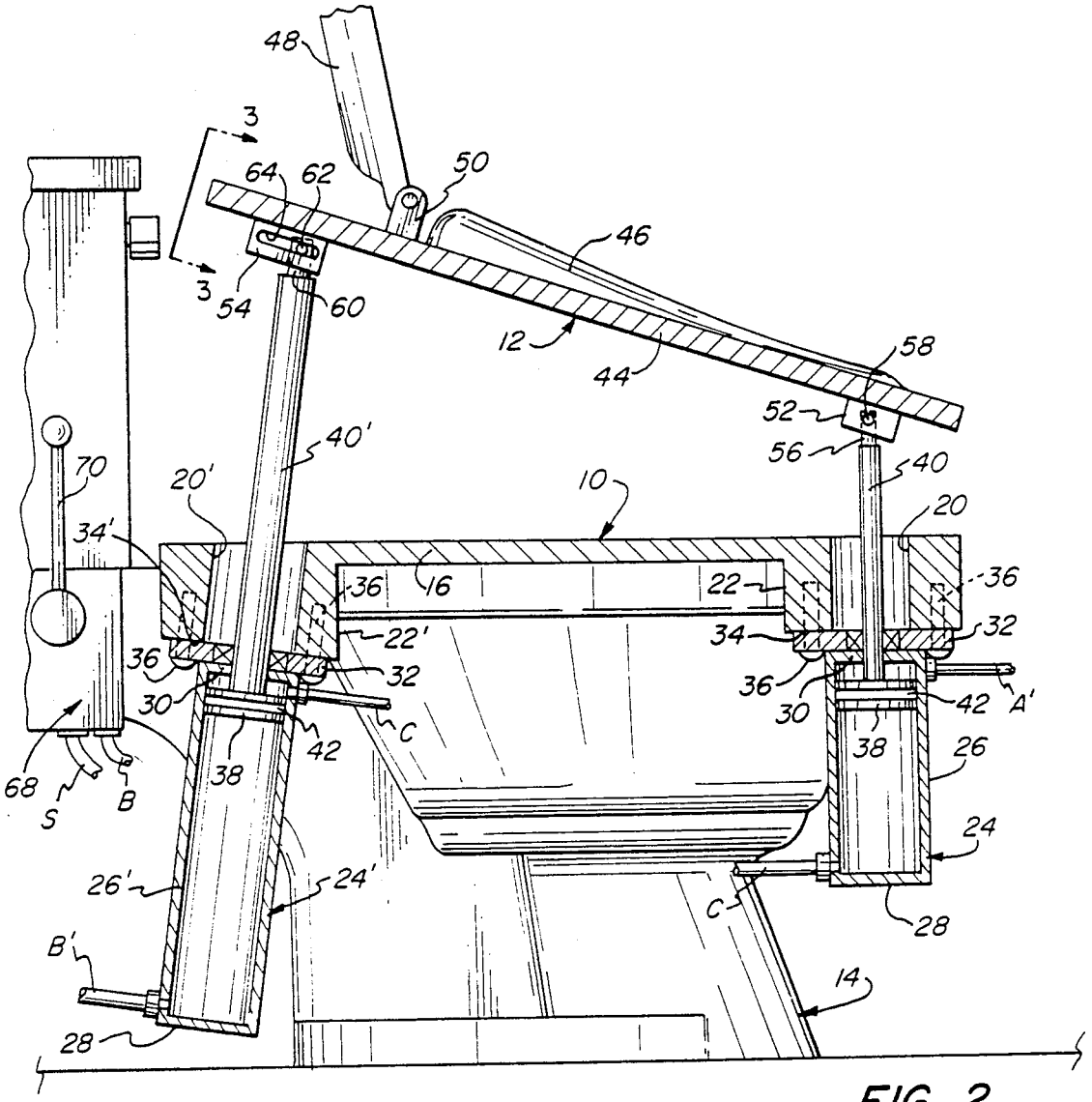
FIG. 2 is an elevational view showing the assembly of FIG. 1, taken in vertical section along a plane through the hydraulic motors.
Figure 3:
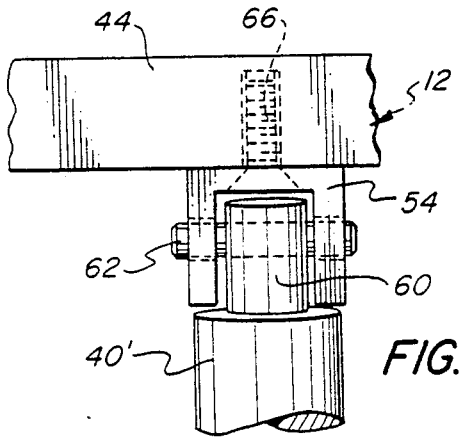
FIG. 3 is a fragmentary elevational view, drawn to an enlarged scale, showing the parts by which the piston rod of one of the rear motors is connected to the seat assembly platform.

The valve 68 is in the form of a standard "closed center" three-position, four-ported hydraulic valve. With its element centralized (to which position the element is normally biased, by means not shown) no water will flow through the valve. Moving the handle 70 to the full line position depicted in FIG. 5A will shift the element so as to cause the parallel channels of section 72 to align between the ports to which the lines S and A, and E and B, respectively, are connected, allowing water to flow through the branches A' A" and thereby to depress the pistons of the front motor cylinders 24 (assuming that the seat member is initially in an elevated position, as depicted in FIG. 2). This will force water present below the heads 38 to flow through the common lines C to the tops of the back motor cylinders 24', urging them downwardly as well. At the same time, water in the space beneath the heads of the back cylinders will flow in sequence through the branches B', B'', the valve 68, and the exit line E, to empty into the toilet tank. Thus, the hydraulic motors will drive the seat member 12 to the lowered position of FIG. 4.

Shifting the handle 70 in the opposite direction, to the position shown in full line in FIG. 5B, will bring the crossover section 74 of the valve element into registry with lines A, B, S and E, permitting water from the supply line S to flow through the line B (and thus the branches B', B'' thereof) into the bottoms of the back motor cylinders 24'. This will of course elevate the associated pistons, and will cause the water that is present above the heads thereof to flow through the lines C and into the bottoms of the front motor cylinders 24, thereby forcing upwardly the pistons thereof as well. Water contained behind the heads of the front motor pistons will thereupon flow sequentially through branch lines A', A'', the valve 68, the exit line E, and ultimately into the reservoir tank. This will of course elevate the seat member 12 toward the position shown in FIGS. 1 and 2.

It will be appreciated that the release of force on the handle 70 at any point will bring the valve element to its neutral, centered position, thereby terminating all flow through the valve and, in turn, maintaining the seat member at any level that it has then attained. It will also be noted that the common lines C cross one another, so as to hydraulically connect the back motor cylinder 24' on one lateral side of the assembly to the front motor cylinder 24 on the opposite side thereof, and vise versa. This stabilizes the system and helps to maintain a uniform lateral orientation of the seat member.

A particularly unique feature of the assembly of the invention resides in the fact that in its elevated positions the plateform 44, and accordingly the seat member 46, assumes an orientation that is titled forwardly from the horizontal, thereby facilitating mounting and dismounting of the user. It will be understood that the pitch of the seat will increase with increasing elevation of the seat member.

It is of course for the purpose of achieving this effect that the lengths and diameters of the forward and rearward piston rods differ from one another. The larger diameter of the rearward rods compensates for their greater length in such a manner as to define equal volumetric spaces above the piston heads in all motors, despite the extra distances through which the back pistons travel.

More particularly, the volume of water contained above each piston head will be a function of the annular area defined between the cylinder wall and the piston rod, and the length of rod extension into the cylinder. By using cylinders that are of all of the same diameter, the rod diameters can be proportioned directly to the desired travel length differentials in such a way as to maintain equal volumes of water above the piston heads despite the greater travel of the rear pistons.

Because of this relationship, the volume of water forced from above the pistons of the back motors, during elevation from the seat member position shown in FIG. 4 to that of FIG. 2, will be just sufficient to fully extend the pistons of the front motors, the travel length of which is of course substantially less. Conversely, the volume of water that is displaced during lowering of the pistons of the front motors will suffice to fully depress the back motor pistons, and to thereby bring the seat member to a position disposed directly upon the base 10.

By way of specific example, the inside diameter of all motor cylinders may be 2 inches, the diameter of the front motor piston rods may be $\frac{5}{8}$ inch, and the diameter of the rods of the back motors may be $1\frac{1}{8}$ inches. This will enable the pistons of the back motors to move through a 9-inch travel length concurrently with movement of the pistons of the front motors through a distance of slightly less than 6 inches.

Figure 6:
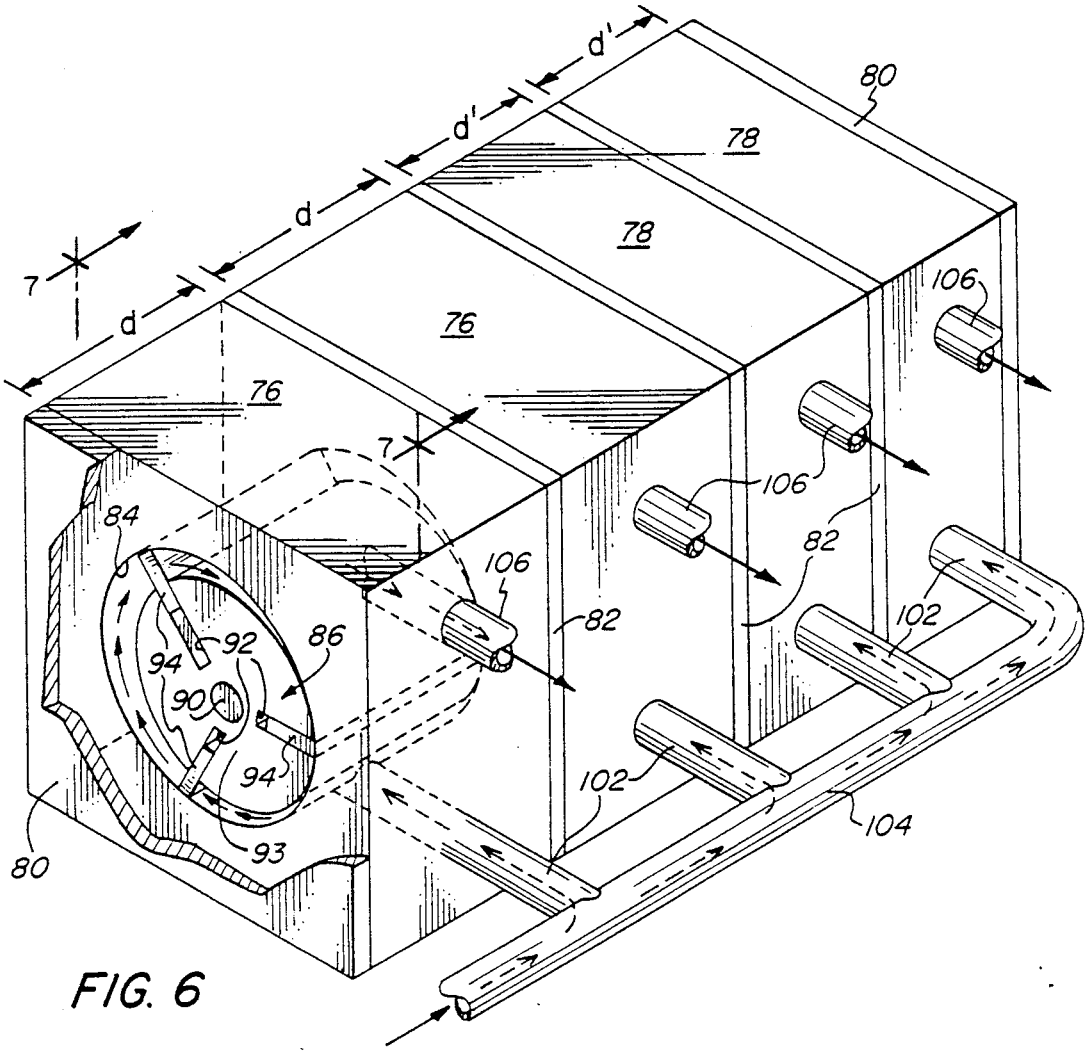
FIG. 6 is a perspective view of a liquid divider unit embodying the invention and suitable for use as a component of the hydraulic operating means of the seat assembly, with a portion of an end wall broken away to expose internal features.
Figure 7:
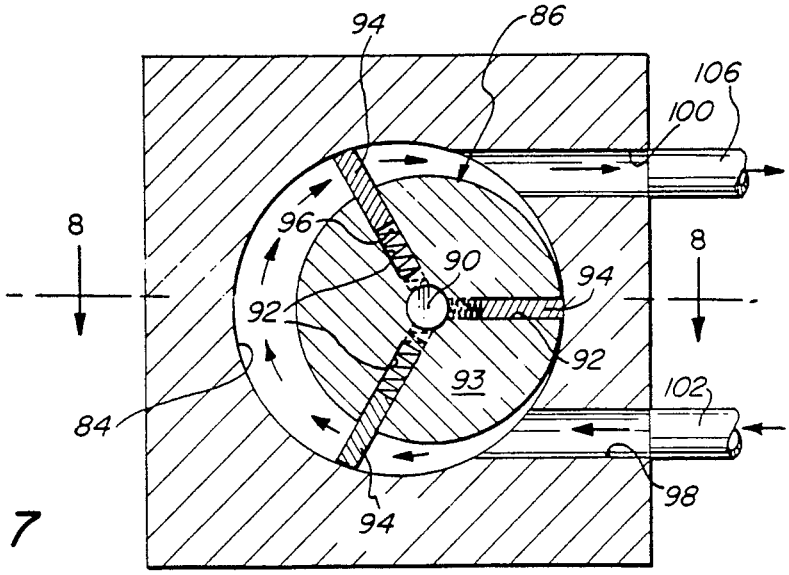
FIG. 7 is a vertical sectional view of the unit shown in FIG. 6, taken along line 7—7 thereof.
Figure 8:
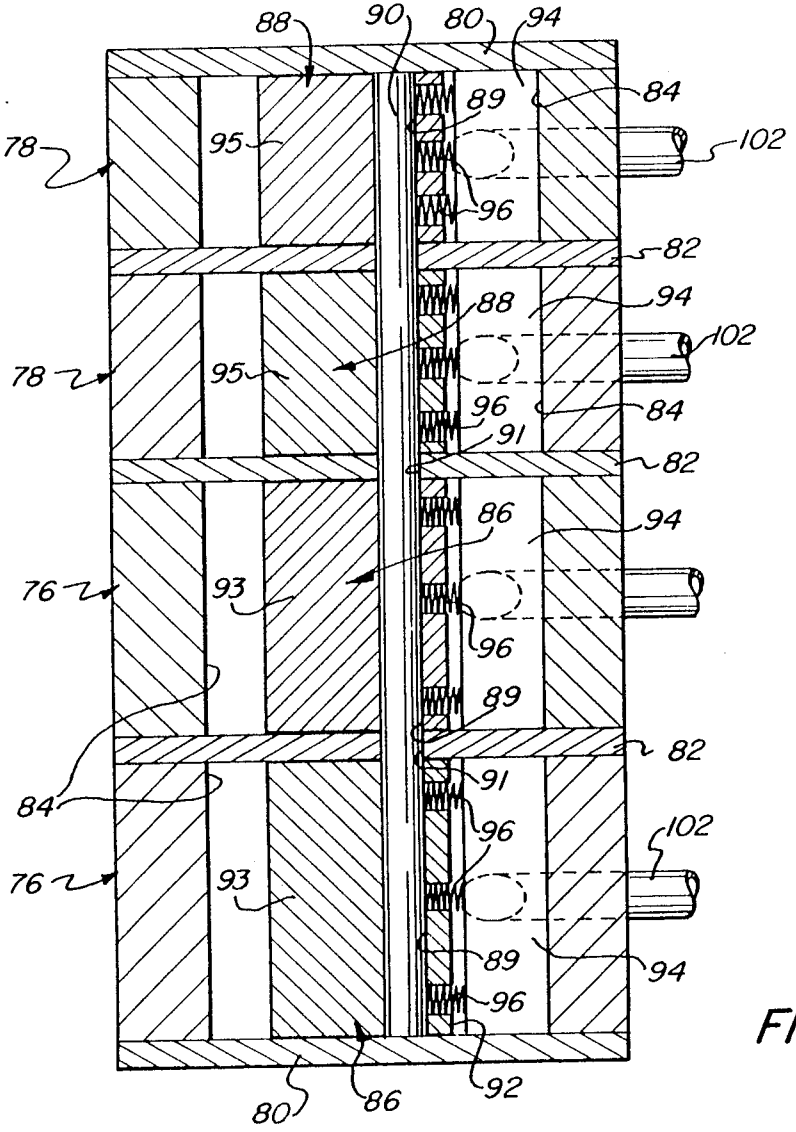
FIG. 8 is a horizontal sectional view of the divider unit taken along line 8—8 of FIG. 7.

Turning finally to FIGS. 6–8 of the drawings in detail, therein illustrated is a four-cavity, positive displacement fluid divider unit suitable for use to power four hydraulic motors of the kind utilized in the assembly hereinabove described. The unit consists of an assembly of four blocks, generally designated by the numerals 76 and 78; the blocks are of square cross section and are substantially identical, excepting only that the width dimension "d" of the two blocks 76 is fifty percent greater than the width dimension "d'" of the two blocks 78. Cover plates 80 are affixed over the opposite ends of the block assembly, and separating plates 82 are interposed between adjacent blocks. Each block 76, 78 has a cylindrical cavity 84 extending through it laterally; the cavities are coaxial with one another, and are all of the same diameter.

One of the rotors, generally designated by the numeral 86 or 88, is disposed within the cavity 84 of each block 76, 78. The rotors are fixed upon a common shaft 90, which passes through the axial bores 89 in their cores 93, 95, and through apertures 91 in the separator plates 82. The core of each rotor has three slots extending radially inwardly from its circumferential surface, and at equiangularly spaced locations thereabout. A flat vane 94 is slidably received within each slot 92, and is biased outwardly by three coil springs 96 disposed behind the vane at the bottom of the mounting slot. The diameter of the rotor cores 93, 95 is substantially smaller than is that of the cavities 84, and the axis of the common shaft 90 is offset from that of the axis cavities; as the rotors rotate, the vanes 94 slidingly engage the confronting surfaces of the blocks 76, 78 and the plates 80, 82, and serve to define cavity chambers or compartments of dynamically varying volume in cooperation therewith.

Upper and lower passages 98, 100 extend into the cavity 84 of each block, opening therewithin at points disposed to opposite sides of an imaginary diametrical plane. A pipe 102 communicates with each of the lower passages 98, and connects to a manifold 104; the upper passages 100 communicate with pipes 106, each of which will lead to the machine or mechanism that is to be powered.

Assuming use of the divider unit in a system such as that of FIGS. 1–5, the pipes 106 from the wider blocks 76 would be connected, through an appropriate valving arrangement, to the cylinders 24' of the back motors, with the pipes 106 from the narrower blocks 78 being connected therethrough to the cylinders 24 of the front motors. The common manifold 104 would be connected to a water supply source.

In operation, water flowing into the pipes 102 and through the lower passages 98 would fill the cavity chambers defined, at the outlet thereof, between adjacent vanes 94 and the encompassed confronting surfaces of the block and the rotor cores. The inflowing water would of course induce rotation of all rotors 86, 88 (in the direction indicated by the arrows in FIGS. 6 and 7), causing them to turn, of necessity, simultaneously and at the same angular rate due to their attachment to the common shaft 90. The volumes of water drawn into the cavity chambers would be apportioned in precise and direct relationship to the axial lengths of the cavities (i.e., the thicknesses "d", "d'" of the blocks 76, 78), and accordingly the blocks 76 would handle fifty percent more water than would the blocks 78.

As the rotors turn, the water collected within the chamber compartments would of course be discharged through the upper passages 100, and ultimately to the several motor cylinders. Because of the volumetric apportionment of the water, the pistons of the back motors would be driven fifty percent further than those of the front motors, assuming equal cross-sectional areas (rather than the unequal annular areas that exist above the piston heads of the motors employed in the illustrated embodiment). Needless to say, return of the pistons would be achieved by flow reversal, using a suitable element of the interposed valve arrangement. That is, the water from the chambers would be conducted to the bottoms of the cylinders in a first position of the valve element, and to the tops of the cylinders in a second position; the valve arrangement would also permit the water to exit to a selected sink (e.g., the toilet tank or bowl).

It will be appreciated that the fluid divider unit described has wide applicability in diverse systems; use for powering an hydraulically operated toilet seat assembly is merely exemplary, and is not therefore to be construed in a limiting sense. It will also be appreciated that many modifications may be made to the toilet seat assembly itself, and to the components thereof, without departure from the novel concepts of the instant invention.

For example, although the base of the assembly is advantageously constructed for support directly upon the toilet bowl, it may also be desirable to provide free-standing means for supporting the assembly on the floor. Similarly, the particular dimensions and configurations of the hydraulic motors illustrated and described are not to be taken as limiting, and the seat element may have a configuration very different from that which is shown, as for example to afford optimal weight distribution on the legs and thighs of the user. The forward tilt that is produced as the seat member rises greatly facilitates mounting and dismounting, and therefore represents a particularly desirable feature of the preferred embodiments of the invention; nevertheless, novelty is also regarded to reside in the broader concepts disclosed herein. Finally, it will be understood that the materials of construction will be selected to afford facile and economical manufacture, durability, functional adequacy, and desirable aesthetic qualities, all of which will be evident to those skilled in the art.

Thus, it can be seen that the present invention provides a novel toilet seat assembly that can be raised and lowered by hydraulic means, using available household water as the power source, in which assembly the seat member may automatically assume a forward tilt, as it is brought to higher levels, and return to horizontal as it is lowered. The invention also provides unique hydraulic operating means, suitable for use for driving such a seat assembly; in particular, it provides a liquid divider unit for apportioning water flow from a common source so as to drive hydraulic motors having capacities that differ from one another. The assembly is secure and stable, and is comfortable and convenient to employ. Both the seat assembly and also the divider unit are highly reliable and effective in use, are relatively uncomplicated and inexpensive to manufacture, and are facile to install.

Having thus described the invention, what is claimed is:

1. An hydraulic toilet seat assembly, comprising a toilet seat member having forward, rearward and laterally opposite side portions; and hydraulic operating means including at least one front motor and one back motor, said motors having means for connecting them to an hydraulic supply for simultaneous operation, and each having a piston, movable through a travel length between a fully retracted position and a fully extended position, the travel length of said back motor piston being substantially greater than that of said front motor piston, said pistons of said front and back motors being operatively connected to said forward and rearward portions of said seat member, respectively, said operating means disposing said seat member in a lowered position and a generally horizontal attitude with said pistons in said fully retracted positions thereof, and disposing said seat member in an elevated position and a forwardly tilted attitude in said fully extended positions of said pistons.

2. The assembly of claim 1 wherein each of said motors comprises a generally vertically disposed hydraulic cylinder in which said piston thereof is slidably mounted, said piston being comprised of a head having an upper side and a lower side, and a rod attached to said head and extending from said upper side thereof, said piston rods being operatively connected to said seat member.

3. The assembly of claim 2 wherein said piston rod of said front motor is substantially shorter than said piston rod of said back motor.

4. The assembly of claim 3 wherein each of said cylinders has ports adjacent the upper and lower ends thereof and communicating, respectively, with internal spaces above and below said piston head thereof, and wherein said assembly additionally includes an hydraulic line attached to each of said ports, said port adjacent said upper end of said back motor cylinder being connected by a common hydraulic line to said port adjacent said lower end of said front motor cylinder.

5. The assembly of claim 3 wherein said front motor cylinder is substantially shorter, in effective length, than is said back motor cylinder.

6. The assembly of claim 5 wherein said cylinders are of the same inside diameter, and wherein said piston rod of said front motor is of substantially smaller cross section than is said piston rod of said back motor.

7. The assembly of claim 3 including two of said front motors and two of said back motors, said pistons of one of said front motors and one of said back motors being operatively connected to said seat member on one of said side portions thereof, and said pistons of the other of said front and back motors being so connected on the other of said side portions.

8. The assembly of claim 7 wherein each of said cylinders has ports adjacent the upper and lower ends thereof communicating, respectively, with internal spaces above and below said piston head thereof, and wherein said assembly additionally includes an hydraulic line attached to each of said ports, said port adjacent said upper end of said back motor cylinder that is operatively connected to said one side of said seat member being connected, by a first common hydraulic line, to said port adjacent said lower end of said front motor cylinder that is operatively connected to said opposite side of said seat member, and said port adjacent said upper end of said back motor cylinder that is operatively connected to said opposite side of said seat member being connected, by a second common hydraulic line, to said port adjacent said lower end of said front motor cylinder that is operatively connected to said one side of said seat member.

9. The assembly of claim 1 additionally including a base adapted for mounting upon the bowl of a toilet, said motors of said hydraulic operating means being attached to and supported by said base.

10. The assembly of claim 1 wherein said operating means additionally includes an hydraulic valve operatively connected to said front and back motors, said valve being adapted for connection to a pressurized water supply and a water discharge sink, for control of the flow of water into and out of said motors.

11. The assembly of claim 1 wherein said hydraulic operating means includes a liquid divider unit for apportioning water flow, from a common source, into different volumetric amounts suitable for operating said front and back motors.

12. The assembly of claim 11 wherein said divider unit includes a plurality of jointly operative pumping sections, one of said pumping sections receiving and delivering to said front motor a first volumetric amount of water, and another of said pumping sections receiving and delivering to said back motor a second volumetric amount of water, said second volumetric amount being larger than said first volumetric amount by a quantity sufficient to produce said substantially greater travel length of said back motor piston.

13. The assembly of claim 12 wherein said unit comprises a body containing a plurality of discrete and hydraulically isolated cavities, each cavity having a rotor rotatably disposed therein and cooperating therewith to dynamically create a multiplicity of chambers of continuously increasing and decreasing volume, so as to provide one of said pumping stations, said body also providing an inlet to and an outlet from each of said cavities disposed so as to permit said rotors to draw water into said chambers and to discharge water therefrom, said rotors being operatively interengaged for conjoint rotation.

14. The assembly of claim 13 wherein said cavities of said body are cylindrical and coaxial, and wherein said rotors include cores that are also cylindrical and of a diameter substantially smaller than the diameter of said associated cavity, said rotors being disposed on a common axis of rotation parallel to and offset from the axis of said cavities, each of said rotors also including a plurality of vanes slidably mounted, at equiangularly spaced positions about said core, for radial movement to maintain constant, sliding engagement with the walls of said body defining said cavities.

15. The assembly of claim 14 wherein said operating means includes two of said front motors and two of said back motors, and wherein said body of said divider unit includes four of said cavities, each of two of said cavities receiving and delivering said first volumetric amount of water, and each of the other two of said cavities receiving and delivering said second volumetric amount of water.

* * * * *